US008042773B2

(12) United States Patent
Bramauer et al.

(10) Patent No.: US 8,042,773 B2
(45) Date of Patent: Oct. 25, 2011

(54) METHOD AND DEVICE FOR DEACTIVATING DEFECTIVE DOORS

(75) Inventors: Johann Bramauer, Ybbsitz (AT); Karl Reder, Linz (AT)

(73) Assignee: Knorr-Bremse Gesellschaft mit Beschrankter Haftung, Modling (DE)

( * ) Notice: Subject to any disclaimer, the term of this patent is extended or adjusted under 35 U.S.C. 154(b) by 425 days.

(21) Appl. No.: 11/989,726

(22) PCT Filed: Jul. 31, 2006

(86) PCT No.: PCT/EP2006/007562
§ 371 (c)(1),
(2), (4) Date: Dec. 15, 2008

(87) PCT Pub. No.: WO2007/014735
PCT Pub. Date: Feb. 8, 2007

(65) Prior Publication Data

US 2009/0084909 A1 Apr. 2, 2009

(30) Foreign Application Priority Data

Aug. 1, 2005 (AT) ..... A 1293/2005

(51) Int. Cl.
*B61K 1/00* (2006.01)

(52) U.S. Cl. ..... 246/169 R; 49/94; 105/341

(58) Field of Classification Search ..... 105/332, 105/333, 339, 341, 343
See application file for complete search history.

(56) References Cited

U.S. PATENT DOCUMENTS 1,476,711 A * 12/1923 Gottschalk ..... 49/94
2,827,977 A * 3/1958 Moore ..... 105/341
3,368,081 A * 2/1968 Giesking ..... 250/230
3,575,604 A * 4/1971 Smith ..... 307/9.1
4,041,470 A * 8/1977 Slane et al. ..... 701/35
4,338,553 A * 7/1982 Scott, Jr. ..... 318/266

(Continued)

FOREIGN PATENT DOCUMENTS

DE 39 21 157 C1 10/1990

(Continued)

OTHER PUBLICATIONS

Japanese Examination Report No. 2008-524418 filed Apr. 13, 2010—in German Language.

(Continued)

*Primary Examiner* — Joe Morano, IV
*Assistant Examiner* — Jason C Smith
(74) *Attorney, Agent, or Firm* — Barnes & Thornburg LLP

(57) ABSTRACT

A method for deactivating a defective door of a train. The method steps include: providing a first door and a first controller; providing a second door and a second controller; providing a separate remote, central activation device configured to transmit an activation signal; determining that a fault has occurred at the second door; and deactivating the second door by an activation signal transmitted from the remote, central activation device via the first controller. A deactivation apparatus for deactivating a defective door of a train, the deactivating apparatus including: a first train door, a first controller, and a first locking device; a second train door, a second controller, and a second locking device, wherein the second train door is a defective train door; a separate, central control center connected to the first and second train doors and configured to provide and transmit an activation instruction, wherein the defective train door is deactivated by the activation instruction via the first locking device of the non-defective door.

7 Claims, 1 Drawing Sheet

U.S. PATENT DOCUMENTS

| | | | | |
|---|---|---|---|---|
| 4,949,804 | A * | 8/1990 | Bartel | 180/287 |
| 4,981,084 | A * | 1/1991 | Templeton et al. | 105/341 |
| 5,119,739 | A * | 6/1992 | Templeton et al. | 105/341 |
| 5,134,350 | A * | 7/1992 | Mahoney | 318/466 |
| 5,892,441 | A * | 4/1999 | Woolley et al. | 340/539.26 |
| 7,497,529 | B2 * | 3/2009 | Lesesky et al. | 303/123 |
| 2008/0190151 | A1 * | 8/2008 | Ritt et al. | 70/95 |
| 2009/0084909 | A1 * | 4/2009 | Bramauer et al. | 246/169 R |

FOREIGN PATENT DOCUMENTS

| | | | |
|---|---|---|---|
| DE | 199 13 996 | A1 | 9/1999 |
| EP | 0 168 520 | A1 | 10/1986 |
| EP | 0 947 658 | B1 | 10/1999 |
| JP | 9-71240 | | 3/1997 |
| JP | 9-301161 | | 11/1997 |
| JP | 2003-252201 | | 9/2003 |
| JP | 2005-14784 | | 1/2005 |

OTHER PUBLICATIONS

German Language Document related to JP 2005-14784.
German Language Document related to JP 9-301161.
German Language Document related to JP-9-71240.

* cited by examiner

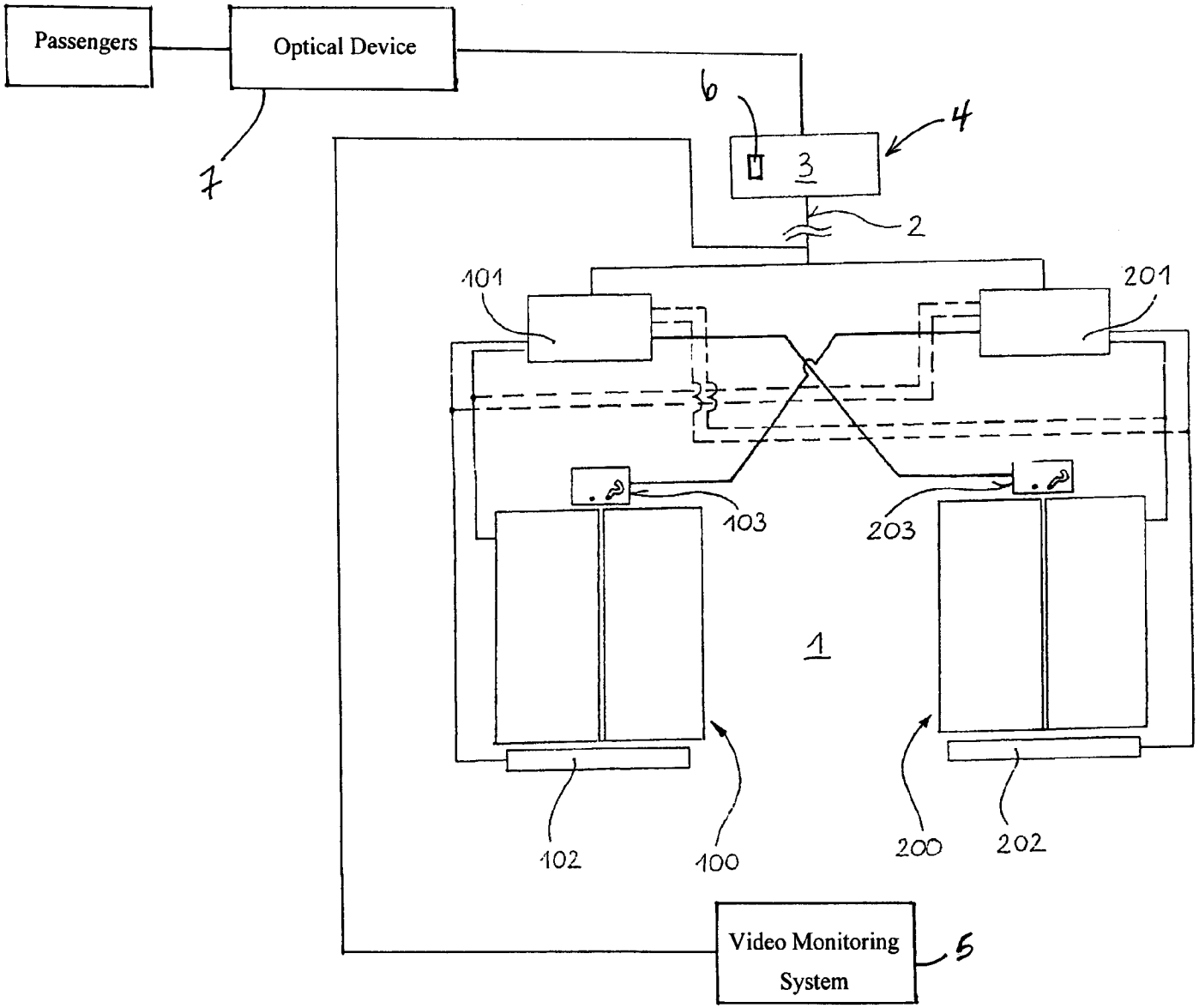
Passengers
Optical Device
7
6
4
3
2
101
201
103
203
1
100
200
102
202
5
Video Monitoring System

METHOD AND DEVICE FOR DEACTIVATING DEFECTIVE DOORS

BACKGROUND AND SUMMARY

The present disclosure relates to a device for deactivating defective doors or defective movable steps of a train.

In passenger trains, local trains and underground railways, the door monitoring system usually transmits signals relating to the functional capability and the operating state of doors and movable steps for ease of comprehension, reference will be made herein only to doors, which include doors and steps, unless specific comments regarding steps alone are meant. The signals are transmitted to a central location, for example into the tractive unit, or to the driver of the train or locomotive. The door monitoring system signals the operating state of the doors, and thus also the occurrence of a defect together with the specification of the affected door. If such a fault occurs, the employee who is responsible for this must go to the defective door and lock this door manually and deactivate its door controller. With the often customary large train lengths of 100 or 200 meters and more, this can result in delays and disruption during operation, in particular when there is a dense sequence of trains.

The present disclosure relates to a method and a door controller with which the above-mentioned inconvenient, time-consuming, and in many cases dangerous, activity is dispensed with.

For this purpose, the present disclosure provides that if a fault occurs at a door, the deactivation of the defective door is carried out under remote control by the central monitoring system for the doors. This is done either directly or indirectly by the controller of an assigned, non-defective door.

The device, according to the present disclosure, is of simple design and comprises an activation device for the emergency locking device. The emergency locking device is activated manually according to the prior art. The device can be a motor, a solenoid, etc., but it is essential that its actuation, the control of the emergency locking device, takes place independently of the control of its "own" door since the latter may, of course, under certain circumstances become defective and thus cause the fault. It is therefore necessary to produce a separate connection to the data bus system which extends through the entire train, which does not constitute a problem per se. Usually, at the end of the activation of the emergency locking device, the door is also decoupled from the door controller in order to prevent colliding instructions. This is done in an analogous fashion for the remote-controlled activation of the emergency locking device.

However, it is also necessary to provide a power supply for emergency activation of the door and for the control of the emergency locking device, which is difficult under certain circumstances. In such cases, it is advantageous, for spatial reasons, to attach the fault circuit to the normal door controller of a door located in the vicinity, for example, opposite the affected door. The connection could also be made to the air conditioning system controller or the like, but the aforesaid assignment to the door located in the vicinity is simple and easy to understand.

It therefore, according to the present disclosure, becomes possible not only to detect and locate a defective door centrally, as in the past, but also to deactivate it and disconnect it from the controller.

In cases in which the failure of a door system occurs in the "door wing open" position, the deactivation also comprises the closing process of the door, either the entirety or only the missing part thereof. In order also to solve this problem, in an embodiment according to the present disclosure, the door controller is not only connected to the door drive of its "own" door but also to the door drive of at least one further door, referred to herein as the assigned door. In the case of a defect, the door controller of the intact door then initiates the closing movement of the defective door and controls it.

In an embodiment according to the present disclosure, it is provided that the door which has been deactivated is signaled as unusable to the passengers by an optical device so that at least the passengers who are leaving the train can be provided in good time with the possibility of looking for another exit.

In a further embodiment according to the present disclosure, there is provision, in particular in cars which are already equipped with video monitoring systems, also to use these video monitoring systems to assess the satisfactory deactivation without the employee who is responsible for this having to go in person to the defective door. It is therefore possible, for example, to monitor the satisfactory closing of the door within the course of the deactivation process.

Other aspects of the present disclosure will become apparent from the following descriptions when considered in conjunction with the accompanying drawings.

BRIEF DESCRIPTION OF THE DRAWINGS

The FIGURE is a schematic, block diagram showing how to deactivate a defective door by a controller of a functioning door, according to the present disclosure.

DETAILED DESCRIPTION

The FIGURE shows, in a purely schematic form, two doors 100, 200 with sliding steps 102, 202 having controllers 101, 201, respectively, in a rail car 1. The two doors 100, 200 are essentially identical. The same parts of the two doors 100, 200 have the same, last two-digit reference numbers, i.e., 101, 102, while components which are not assigned specifically to one the doors 100, 200 have single-digit reference numbers. The two door controllers 101, 201 are connected to a data bus 2 which runs through the entire train and which is also connected to the activation device 3. The activation device 3, may, for example, be in the driver's cab, and usually also transmits data for controlling the air conditioning system, the lighting system, etc.

To simplify the FIGURE, various sensors, i.e., anti-trapping protection, reaching of the final closed position, and activation devices, i.e., normal opening, emergency opening, of the doors 100, 200 are not shown since they are not relevant to an explanation of the method or device, according to the present disclosure.

The data bus 2 is connected to the door controllers 101, 201 and transmits central instructions. For example, the central instructions may be instructions enabling an opening of the doors, 100, 200 usually controlled according to a left-hand/right-hand side of the train, instructions for enabling a closing of the doors, 100, 200, and also instructions to the lighting system, the air conditioning system, etc. which instructions are ignored by the door controllers 101, 201 because these instructions are not addressed to them. The door controllers 101, 201 do react to instructions directed to them and transmit completion messages, or in the case of detection, a fault message, via the data bus 2.

Assuming, for example, there is a fault in the door 200, the present disclosure provides for an output of an activation instruction from activation device 3 to an emergency locking device 203 from a central monitoring system or central control center 4, for example, co-located with activation device 3, via the data bus 2 and the non-defective door controller 101. As a result, an emergency locking of the door 200 is carried out and its controller 201 is switched off. The emergency locking device 203 is independent of the door controller 201 as far as logic and the power supply are concerned, and it is therefore no longer affected by a fault at the door 200. Assuming, for example, there is a fault in the door 100, the present disclosure provides for an output of an activation instruction from activation device 3 to an emerging locking device 103 from the central control center 4, for example, co-located with activation device 3 via data bus 2 and the non-defective door controller 201. As a result, an emergency locking of the door 100 is carried out and its controller 101 is switched off. The emergency locking device 103 is independent of the door controller 101 as far as the logic and power supply are concerned, and it is therefore no longer affected by a fault at the door 100.

In a video monitoring system 5, according to the present disclosure, the system 5 is directed at the defective door, for example, door 200, via the data bus 2 and the activation instruction may be switched to a monitor 6 in the control center 4 in order to control and/or observe the satisfactory closing and locking of the door 200.

In an embodiment of the present disclosure, the deactivated door, for example, door 200, is signaled as unusable to passengers by an optical device 7 so that passengers leaving the train 1 are provided in good time with an opportunity to locate an alternate exit.

Sensors (not shown), which monitor the closing and locking and pass on information to the control center 4 via the controller 101 of the functioning door 100 are, for example, also present in the control circuit of the emergency locking device 203.

The sliding step 202 is deactivated similarly to and/or together with the door 200 in an analogous fashion. The same applies to step 102 and door 100.

It is within the scope of the present disclosure, however, to provide a separate sliding door fault procedure if a fault is detected at the sliding step 202 when the door 200 is otherwise functionally capable. The sliding step 202 can then be secured in a predetermined position and taken over by the controller 201, and the door 200 itself remains functionally capable. However, this requires a separate connection of the sliding step 202 to the data bus 2 and a separate power supply, and, in this case, the sliding step 202 has to be treated like a door in itself.

The present disclosure has thus far been described with reference to the transmission of the instructions via the door controller 101 of the door 100 which lies opposite the defective door 200. It is within the scope of the present disclosure, that a separate controller (not shown) with connection to the data bus 2 and a separate power supply (not shown) is also possible. Whether such an embodiment is adopted is a question of expenditure and of the safety principles of the operator.

In a further embodiment, according to the present disclosure, it is also possible to initiate and/or control not only the locking device 203 of the defective door 200 but also the closing process of the door wings. That also applies, if appropriate, to the retraction or folding-in process of the door step 202 by the door controller 101 of door 100 which is located in the vicinity, for example opposite or adjacent. This would be necessary, in particular, if a door system fails in the open position or in a not quite entirely closed position of the door wing or wings. For such a purpose, the door drive or step drive of the respective doors, according to the present disclosure, are connected to the door controller 101 of the assigned, that is to say non-defective, door 100. In the FIGURE, such connections are shown in a schematic fashion by dashed lines.

For example, according to the present disclosure, it is possible to combine two doors in one train or one car, as is illustrated. According to the present disclosure, it is conceivable to combine a plurality of doors to form one unit in such a way that the door controller of one door can be used to actuate a plurality of door locking devices.

Although the present disclosure has been described and illustrated in detail, it is to be clearly understood that this is done by way of illustration and example only and is not to be taken by way of limitation. The scope of the present disclosure is to be limited only by the terms of the appended claims.

We claim:

1. A method for deactivating a defective door of a train, the method steps comprising:

providing a first door and a first controller associated with the first door;

providing a second door and a second controller associated with the second door;

providing a separate remote, central activation device configured to transmit an activation signal;

determining that a fault has occurred at the second door; and deactivating the second door by an activation signal transmitted from the remote, central activation device via the first controller.

2. The method as claimed in claim 1, wherein when the fault occurs at the second door in an open position of the second door, a closing process of the second door takes place via the first controller of the first door.

3. The method as claimed in claim 1, wherein the second door is signaled as unusable to passengers by an optical device.

4. The method as claimed in claim 1, wherein the deactivating of the second door is monitored by a video monitoring system.

5. A deactivation apparatus for deactivating a defective door of a train, the deactivating apparatus comprising:

a first train door, a first controller, and a first locking device, wherein the first train door is a non-defective train door;

a second train door, a second controller, and a second locking device, wherein the second train door is a defective train door;

a separate, central control center connected to the first and second train doors and configured to provide and transmit an activation instruction; and wherein the defective train door is deactivated by the activation instruction via the first locking device of the non-defective door.

6. The deactivation apparatus as claimed in claim 5, wherein the second locking device is connected to the first controller of the non-defective train door.

7. The deactivation apparatus as claimed in claim 5, wherein the central control center is located remotely from the train doors.

* * * * *